US009578914B2

(12) United States Patent
Fierro

(10) Patent No.: US 9,578,914 B2
(45) Date of Patent: Feb. 28, 2017

(54) METHOD OF AND SWIM CAP PRODUCT FOR KEEPING TRACK OF SCHEDULED SWIM MEET EVENTS, HEATS AND LANES

(71) Applicant: Edward Kip Fierro, Greenwich, CT (US)

(72) Inventor: Edward Kip Fierro, Greenwich, CT (US)

( * ) Notice: Subject to any disclaimer, the term of this patent is extended or adjusted under 35 U.S.C. 154(b) by 272 days.

(21) Appl. No.: 14/323,697

(22) Filed: Jul. 3, 2014

(65) Prior Publication Data

US 2014/0317820 A1 Oct. 30, 2014

Related U.S. Application Data

(63) Continuation-in-part of application No. 13/207,833, filed on Aug. 11, 2011, now abandoned.

(60) Provisional application No. 61/443,382, filed on Feb. 16, 2011.

(51) Int. Cl.
*A42B 1/12* (2006.01)
*A63B 33/00* (2006.01)

(52) U.S. Cl.
CPC ..... *A42B 1/12* (2013.01); *A63B 33/00* (2013.01)

(58) Field of Classification Search
CPC ..... A42B 1/12; A42B 1/004; A42B 1/248; A63B 33/00
USPC ..... 2/68
See application file for complete search history.

(56) References Cited

U.S. PATENT DOCUMENTS 753,457 A * 3/1904 Weissbord ..... A47B 23/002 16/DIG. 12
2,119,498 A * 5/1938 Spanel ..... A42B 1/12 2/68
2,285,659 A * 6/1942 Howland ..... A42B 1/12 2/68
2,353,403 A * 7/1944 Howland ..... A42B 1/12 2/68
2,577,717 A * 12/1951 Stevens ..... A42B 1/248 2/181
3,135,442 A * 6/1964 Carter, Jr. ..... A41B 11/001 2/239
3,255,460 A * 6/1966 Pastore ..... A42B 1/12 2/68
3,872,515 A * 3/1975 Miner ..... A41D 19/0082 2/168
D238,522 S * 1/1976 Gullis ..... 2/68
3,979,777 A * 9/1976 Gregg ..... A42B 1/12 2/68

(Continued)

*Primary Examiner* — Alissa L Hoey
(74) *Attorney, Agent, or Firm* — Hess Patent Law Firm; Robert J. Hess

(57) ABSTRACT

A method and product suited to keep track of swimming meet events, heats and lanes. There is a swimming/bathing cap whose inside facing surface is imprinted or stamped with indicia in the form of swimming competition words or abbreviations of such words, namely, "meet, event, heat, lane" with a sufficient space to the right of each indicia for the cap wearer to write in information pertaining to the indicia. The information may be the name of the swimming meet, name of the event, heat number and lane number. Other items of the kit may be an ink body marker and a remover of the mark left by the ink body marker. All may be sealed in a common package. The ink of the ink body marker is resistant to erasure from water submersion.

10 Claims, 6 Drawing Sheets

(56) References Cited

U.S. PATENT DOCUMENTS 4,170,669 A * 10/1979 Okada ..... C09B 63/00 106/31.01
4,224,358 A * 9/1980 Hare ..... B44C 1/1712 101/470
4,627,110 A * 12/1986 Tengs ..... A41D 1/04 2/115
5,116,410 A * 5/1992 Miller ..... C09D 11/16 106/31.58
5,253,368 A * 10/1993 Blake ..... A42B 1/248 2/195.1
5,349,702 A * 9/1994 Runckel ..... A42B 1/12 2/171
5,556,135 A * 9/1996 Duncan ..... A42B 1/24 2/195.1
5,578,353 A * 11/1996 Drew, III ..... B44C 1/175 283/58
5,704,067 A * 1/1998 Brady ..... G09F 3/005 116/222
5,724,671 A * 3/1998 Theders ..... A42B 1/12 2/161.7
5,745,918 A * 5/1998 Shukla ..... A41D 27/08 2/144
5,901,377 A * 5/1999 Haney ..... A41D 25/00 2/144
5,910,812 A * 6/1999 Yamamoto ..... D06P 5/001 347/106
6,185,746 B1 * 2/2001 Scott ..... A41D 13/0015 2/115
6,253,378 B1 7/2001 Nealy
6,406,203 B1 * 6/2002 Maurer ..... B43K 23/02 401/131
6,421,832 B1 * 7/2002 Ondrejko ..... A41D 1/04 2/115
6,477,714 B1 * 11/2002 Boatwright ..... A42B 1/24 2/171
6,584,618 B1 * 7/2003 Mirharooni ..... A41D 25/00 2/144
6,964,229 B1 11/2005 Zimmerman
7,189,130 B2 * 3/2007 Vega ..... A42B 1/12 2/68
D600,886 S * 9/2009 Kazanjian ..... D2/839
7,661,208 B2 * 2/2010 McKinney ..... A43B 3/0031 36/112
7,971,710 B1 * 7/2011 Zaher ..... A63B 71/0672 206/216
2002/0035197 A1 * 3/2002 Vandahm ..... C09D 11/16 524/549
2004/0173143 A1 * 9/2004 King ..... A63B 71/0672 118/264
2005/0186401 A1 * 8/2005 Chen ..... B42D 1/008 428/195.1
2005/0283880 A1 * 12/2005 Lamson ..... D06Q 1/00 2/69
2006/0016358 A1 * 1/2006 Zimmerman ..... B41K 1/02 101/483
2006/0063856 A1 * 3/2006 Cordova ..... C09D 11/16 523/160
2006/0240250 A1 * 10/2006 Starzynski ..... G09F 3/10 428/343
2008/0079255 A1 * 4/2008 Nakamura ..... B42D 1/001 281/36
2008/0220195 A1 * 9/2008 Henshaw ..... G09F 3/10 428/41.8
2009/0280716 A1 * 11/2009 Normand ..... D06Q 1/00 446/146
2010/0024091 A1 * 2/2010 Mehtab ..... A41D 15/005 2/69
2010/0071109 A1 * 3/2010 Gibson ..... A41D 1/04 2/69
2010/0125298 A1 * 5/2010 Whitney ..... A47G 9/0223 606/234
2014/0338099 A1 * 11/2014 Marscellas ..... A42B 1/248 2/209.13

* cited by examiner

METHOD OF AND SWIM CAP PRODUCT FOR KEEPING TRACK OF SCHEDULED SWIM MEET EVENTS, HEATS AND LANES

CROSS-REFERENCE TO COPENDING PATENT APPLICATIONS

The present application is a continuation-in-part of U.S. Ser. No. 13/207,833 filed Aug. 11, 2011, which claims priority from provisional patent application Ser. No. 61/443,382 filed Feb. 16, 2011.

BACKGROUND OF THE INVENTION

Field of the Invention

The invention relates to a swimming meet kit containing items suited to help competitors identify the events, heats and lanes the are scheduled to compete in for a swimming meet. The items may include a body ink marker, a mark remover, and a swimming/bathing cap imprinted on an inside surface with swim competition words or abbreviations of those words, i.e., meet, event, heat and lane. Sufficient spacing is provided to the right of such words or abbreviations for the wearer of the cap to write in information with the body ink marker. A promotional display may also be used.

Discussion of Related Art

According to the online encyclopedia Wikipedia:

A swim cap, swimming cap or bathing cap, is a silicone, latex or lycra cap worn on the head by recreational and competitive swimmers.

Caps are worn for various reasons. Some facilities require the wearing of swim caps, in order to protect filters from becoming clogged with loose hairs which fall from the scalp of swimmers who are not wearing a cap. Caps are also sometimes worn in an attempt to keep the hair relatively dry or free from chlorinated water, to keep the sun off of the hair, and also, when a cap is worn with ear plugs, in order to keep water out of the ears. Competitive swim caps are made of tightly fitted silicone, latex, or lycra that hugs the skull of its user, providing cover for his or her hair. This reduces drag in the water caused by loose hair. During longer swimming sessions, a swim cap keeps the head warm.

A swim cap, swimming cap or bathing cap, is a silicone, latex or lycra cap worn on the head by recreational and competitive swimmers.

Caps are worn for various reasons. Some facilities require the wearing of swim caps, in order to protect filters from becoming clogged with loose hairs which fall from the scalp of swimmers who are not wearing a cap. Caps are also sometimes worn in an attempt to keep the hair relatively dry or free from chlorinated water, to keep the sun off of the hair, and also, when a cap is worn with ear plugs, in order to keep water out of the ears. Competitive swim caps are made of tightly fitted silicone, latex, or lycra that hugs the skull of its user, providing cover for his or her hair. This reduces drag in the water caused by loose hair. During longer swimming sessions, a swim cap keeps the head warm.

The English "Channel Swimming and Piloting Federation" states that "one standard swim cap" may be used for official English Channel record swims. The cap must be approved by the official observer who accompanies the swimmer on the pilot boat across the channel. "Standard swim caps" used by English Channel swimmers of record over the years include solid rubber "tank" style swim caps, molded rubber swim caps with chin strap, bubble crepe rubber swim caps with chin strap, silicone swim caps and latex "racing" swim caps. Swim caps that have neoprene within the cap construction such as the "Barracuda Hothead" or are completely made of neoprene are not allowed for record English Channel swims. Several other long distance swims such as the Santa Catalina Channel California swim have similar rules for record swims.

According to WiseGeek at www.wisegeek.com:

A swim cap is a silicone or latex head cover worn by recreational and competitive swimmers. Swim caps are also called bathing caps. Keeping the hair out of the face, protecting hair from chlorine or sea salt and reducing the loss of body heat are said to be some of the benefits of wearing a swim cap. Competitive swim caps are also designed to create less drag or resistance in the water.

Swim caps cover the entire head from the forehead to behind the ears to the nape of the neck. Both the silicone and latex types of swim cap are stretchy and made to adjust to different head sizes. Some swim caps even fit both children and adults. A swim cap is not usually recommended for children under age four. Many children's swim caps feature fun designs in bright colors.

Adult swim caps are also colorful and may feature graphic designs. Silicone caps are usually more vivid in color than latex styles. They also may be more comfortable and last longer than latex swim caps. Also, silicone is a more breathable fabric. A latex swim cap is often less expensive than the silicone variety and may be ideal for occasional use.

Both latex and silicone swim caps tend to tear easily from contact with items such as bobby pins or sharp fingernails. A swim cap may be easier to put on if the hair is wet. Many swim caps don't keep hair totally dry anyway as air pockets may be created in the cap during swimming. Shorter hair is usually easier to manage when wearing a swim cap, but longer hair may fit better in the cap if it is first twisted into a bun.

Women's designer swim caps may feature added embellishments such as flower petals made out of latex or silicone. A swim cap may or may not have a strap under the chin. Competitive swim caps may be printed in team colors and logos, but otherwise are as minimal as possible in design. Like swimsuits, swim caps should be rinsed in cold water after use and hung to dry. Damp swim caps are susceptible to mold and mildew, so a swim cap should always be completely dry before it is stored in a drawer or sports bag.

According to Triathlete Sports at www.triathletesports.com:

Silicone caps were originally invented as an alternative cap for people with latex allergies but over time people began to appreciate silicone for other reason than allergies. There are three main reason why silicone is sometimes preferred over latex, it is longer lasting, non-allergy, and it doesn't pull your hair as much. Latex, on the other hand, is less expensive, doesn't slip off very easily, and is more popular among pro swimmers.

Steps & Tips For Putting A Swim Cap On

1. Hold it down by the sides and bend your head down. The caps are slightly oblong at the opening, hold it so it's longest diameter is running parallel with our head, 2. Start putting the cap on at the forehead and work it on down.

Swimmers with really long hair can pull their hair out to the rear and put their caps on half way. Then twist up the rest and tuck it up inside as evenly and as far up as you can.

If you put long hair into a bun it can be hard to get a swim cap to cover smoothly and tightly as the bun makes the cap stick out into a point, which can cause the sides of the cap to not seal well to keep water out.

You might try a wig cap liner. A wig cap liner looks like a fabric swim cap but is thinner. An old stocking cut off and tied off can make a cheap wig cap liner.

A bit of hair preparation goes a long way to help keep hair under your cap where it can be protected and not sticking outside your swimcap!

If your cap is sticky and drags, try rubbing some corn starch on the inside—it will make your caps so slick!

When worn, the swimming cap has an outward facing side and an inward facing (that faces the wearer's head). The printing of a pattern onto the outward facing side of swimming caps is well known and custom printing is offered commercially. It is also well known to print different patterns onto both facing sides of the swimming cap to render the swimming cap "reversible". If the swimming cap is reversible, the swimming cap may be worn with either of the two reversible faces of the swimming cap facing outward at any one time with the other reversible face facing inward (to face the wearer's head).

Body ink markers are conventional whose colorants are approved for cosmetic use, such as by the Color Additives Amendment to the Federal Food, Drug and Cosmetic Act. The ink is removed by rubbing the area of the skin marked with the marker with a wash cloth under running water or with a hand sanitizer or rubbing alcohol. Body ink markers are commercialized by Take Your Mark Sports LLC. According to their instructions, when using the marker for the first time, the marker should be shaken well to mix the ink. The cap is then removed and the tip should be pressed upon to ensure even ink flow, which is visible as the ink fills the marker tip. It can take 1-2 minutes to fill the tip the first time. If necessary, the tip should be pressed 2-3 times to re-ink the marker. Such a press tip feature keeps the ink separate from the tip to render the marker usable even if the cap is left off. The ink will also come out of most clothes during the wash cycle of a washing machine.

Sealing techniques to seal plastic packages containing items is conventional. Some conventional sealing techniques that are effective include thermal welding, sonic welding, and press-to-seal strips that are reclosable such as ziploc.

The online encyclopedia Wikipedia discusses the dye-sublimation printing process on synthetic fabrics.

The dye-sublimation printing process is used to print on polyester or other synthetic fabrics. It is used for applications such as T-shirts, banners, table covers, id cards, sportswear and flags. The original printers were an electrostatic technology using toners but now are generally large format inkjet printers using specially formulated inks. The dye sublimation inks are a pigment suspended in a liquid solvent, like water. The images are initially printed on coated heat-resistant transfer paper as a reverse image of the final design, which is then transferred onto polyester fabric in a heat press operating at a temperature around 180 to 210 C (375 F). Under high temperature and pressure, the dye turns into a gas and permeates the fabric and then solidifies into its fibers. The fabric is permanently dyed so it can be washed without damaging the quality of the image.

Advantages of dye-sublimation over other methods of textile printing:

Images are permanent and do not peel or fade.

Dye does not build up on the fabric.

Colors can be extraordinarily brilliant due to the bonding of the dye to the transparent fibers of the synthetic fabric.

Truly continuous tones can be achieved that are equivalent to photographs, without the use special techniques such as half-screen printing.

The image can be printed all over the entire item, with no difficulty in printing all the way to the edges.

There are two types of dye sublimation inks available in the market. The most popular one is aqueous dye sublimation ink for use in both desktop and large format printers. The other one is solvent dye sublimation ink that can be used in XAAR, Spectra and Konica printhead wide format printers.

USA Swimming publishes the following information at its website www.usaswimming.org:

As the National Governing Body for the sport of swimming in the United States, USA Swimming is a 300,000-member service organization that promotes the culture of swimming by creating opportunities for swimmers and coaches of all backgrounds to participate and advance in the sport through clubs, events and education.

Our membership is comprised of swimmers from the age group level to the Olympic Team, as well as coaches and volunteers. USA Swimming is responsible for selecting and training teams for international competition including the Olympic Games, and strives to serve the sport through its core objectives: Build the base, Promote the sport, Achieve competitive success.

USA Swimming is the National Governing Body for the sport of swimming. We administer competitive swimming in accordance with the Olympic & Amateur Sports Act. We provide programs and services for our members, supporters, affiliates and the interested public. We value these members of the swimming community, and the staff and volunteers who serve them. We are committed to excellence and the improvement of our sport. We are committed to providing a safe and positive environment for all members.

Listed below are some very in-depth guidelines geared to help you through your first couple of swim meets. It may seem a little overwhelming, but we tried to be as specific and as detailed as we possibly could. If you have any questions, please ask your coach.

BEFORE THE MEET STARTS

Arrive at the pool at least 15 minutes before the scheduled warm-up time begins. This time will be listed in the meet information handed out to all swimmers and also in the team newsletter.

Upon arrival, find a place to put your swimmer's blankets, swim bags and/or sleeping bags. The team usually sits in one place together, so look for some familiar faces.

Find the check-in place. Usually, parents are not allowed on deck so this may be a responsibility of your swimmer or your swimmer's coach. Make sure your swimmer checks in with his or her coach! Check for special posted instructions in the check-in area.

Usually one will need to circle the swimmer's name or "#" before each swimmer's name, in each event he or she is swimming, that day. If this is not done, the swimmer will not be allowed to swim that event. Check-in is required so that the people running the meet know who is actually at the meet. After check-in, the meet administrators "seed" the swimmers into heats. Heat and lane assignments will be posted, so be sure your swimmer knows where to look!

Sometimes the meet is "pre-seeded" and no check-in is required. You and your swimmer can find heat and lane assignments by purchasing a program.

Once "checked in", write or have the swimmers write each event-number on his or her hand in ink. This helps him/her remember what events he/she is swimming and what event number to listen or watch for.

Your swimmer now gets his/her cap and goggles and reports to the pool and/or coach for warm-up instructions. It is very important for all swimmers to warm-up with the team. A swimmer's body is just like a car on a cold day-he/she needs to get the engine going and warmed-up before he/she can go all out.

After warm-up, your swimmer will go back to the area where his/her team is sitting and wait there until his first event is called. This is a good time to make sure he/she goes to the bathroom if necessary, gets a drink, or just gets settled in.

The meet will usually start about 10-15 minutes after warm-ups are over. According to USA Swimming rules (because of insurance purposes), parents are not allowed on deck unless they are serving in an official capacity. Similarly, all questions concerning meet results, an officiating call, or the conduct of a meet, should be referred to a coach. He or she in turn, will pursue the matter through the proper channels.

Psyche Sheet or Heat Sheets. A psyche sheet is usually available for sale in the lobby or concession area of the pool. It lists all swimmers in each event in order of "seed time". When the team entry is sent in, each swimmer and his/her previous best time (up to the date that the entry was submitted) in that event is listed. If the swimmer is swimming an event for the first time, he/she will be entered as a "no-time" or "NT". A "no-time" swimmer will most likely swim in one of the first heats of the event. A Heat sheet may be available close to the start of the meet that lists the actual heat and lane a swimmer will be competing in.

MEET STARTS

It is important for any swimmer to know what event numbers he/she is swimming (again, why they should have the numbers on their hand). He/she may swim right away after warm-up or they may have to wait awhile.

Most meets are computerized. There are generally two ways a swimmer gets to his/her lane:

A swimmer usually reports directly to his/her lane for competition a number of heats before he/she actually swims. Check with your swimmer's coach for specific instructions.

In some novice meets, a swimmer's event number will be called, usually over the loudspeaker, and he/she will be asked to report to the "clerk of course" or "bullpen". Swimmers should report with his/her cap and goggle. Generally, girls events are odd-numbered and boys events are even-numbered. Example: "Event #26, 10-Under Boys, 50 freestyle, report to Clerk of Course." The "Clerk of Course" or "bullpen" area is usually where all swimmers checked in before the warm-up.

The clerk will usually line up all the swimmers and take them down to the pool in correct order. You can expect at least 4-8 heats of each event. The swimmer swims his or her race.

After each swim:

He/she is to ask the timers (people behind the blocks at each lane) his/her time.

Depending on the coaches instructions, the swimmer may be asked to do some recovery swimming if a "warm down" pool or lanes are available. The swimmer should then go immediately to his or her coach. The coach will discuss the swim with each swimmer. Some coaches may wish to talk with the swimmer before her recovery swim.

Generally, the coach follows these guidelines when discussing swims:

Positive comments or praise

Suggestions for improvement

Positive comments

Things you, as a parent, can do after each swim:

Tell him how great he did! The coaching staff will be sure to discuss stroke technique with him. You need to tell him how proud you are and what a great job he did.

Take him back to the team area and relax.

This is another good time to check out the bathrooms, get a drink or something light to eat.

The swimmer now waits until his next event is called and starts the procedure again. When a swimmer has completed all of her events she and her parents get to go home. Make sure, however, you, as a parent, check with the coach before leaving to make sure your swimmer is not included on a relay. It is not fair to other swimmers who may have stayed to swim on a relay where your swimmer is expect ed to be a member and she is not there.

Results are usually posted somewhere in the facility. Awards are often gathered for a team and given to the coach at the end of the meet. The coach will give the awards to the swimmers at a later time.

The Badger Junior Team has always been a highly successful USS club, both in the Metropolitan area and nationally, consistently producing nationally ranked Top 10 swimmers as well as Top 10 relays. Badger junior swimmers have gone on to be State, Sectional and Regional Champions, World champions, NCAA and Olympic champions. Head Junior team Coach Kip Fierro, who is the inventor of the present patent application, has been active with Badger for forty years, first as an alumnus of John Collins and then as Badger Age Group Head Coach for over twenty-five years. He has been the Head Coach of the New Rochelle High School team for twelve years, was Head Coach at the New York Athletic Club for eighteen years and Head Coach at Coveleigh Club for three years.

As a result of his decades of swim meet experience and knowledge of the running of swim meets, the inventor has made some observations about swim meets that follow the USA Swimming guidelines.

Children competing in the swimming meet competition is primarily responsible to figure out which event he/she is competing in, which heats for each event he/she is competing in and which lane for each heat he/she is assigned to swim in. Generally, the information is unavailable until shortly before the swim meet starts, because the swimming heat data schedule for each event's heat and lane assignments is adjusted on the day of the competition to take into account no-shows, i.e, swimmers who were scheduled to compete in the swimming meet that day, but did not show up on time prior to commencement of the swimming meet.

Children competing in the swimming meet competition find it necessary to continuously ask their swimming coaches for help in identifying, from the swimming meet schedule, which event they are scheduled to compete in and their heat and lane number assignments. Although they may write the applicable heat and lane numbers on their bodies with a body ink marker, the children competing in the swimming meet competition still check the swimming heat data schedule and/or ask their swimming coaches to verify their heat and lane assignments for each scheduled event they are to compete in. While one might contend that such verification is unnecessary since they wrote the pertinent information on their bodies, the reality is that the children still do seek to verify event, heat and lane information from the posted swimming heat data schedule and from their swimming coaches. Perhaps the children in the competition simply do not trust their interpretation of what information they wrote on their bodies since they are the ones that are charged solely with interpreting what is written. Since multiple heat and lane assignments are involved in their writing and that needs to be correlated with the events they are scheduled to compete it, perhaps the manner in which the information is written on their bodies lends itself to multiple interpretations as to which event, heat and lane information is being identified by what they wrote.

Making a mistake as to the assigned heat and lane number for a scheduled event can have adverse consequences for the child in the swimming competition. For instance, if the child is at the wrong end of the swimming pool when his/her heat is called, the child misses the heat and may have no further recourse to be in the competition for that event. If the child is in a swimming lane assigned to a different child competitor who is late getting there, then the child become aware at the last moment about the mistake from the different child competitor and both children may undergo some stress as a result before competing due to the mix-up in lane assignments. If the child swims in the wrong lane, then the child may or may not be properly credited with having swum in the heat and the competition records may need to be corrected later thereby creating some stress on the meet officials as well the parents. Indeed, swimming coaches, parents and meet officials are under stress during swimming meets as a consequence of the practice of relying upon children to write event/heat/lane assignments on their bodies and to interpret the information written on their bodies so that the children be on time at the right event, right heat and right lane.

The present inventor believes there is a better way to help swimmers be informed as to what their events, heats and lanes are other than by relying upon children to mark their hands and arms with the correct information and relying upon them to interpret what they wrote down. The present inventor that such a better way would relieve stress for coaches, parents and meet officials as well as swimmers, because fewer swimmers would miss their races and would be on time to race in their assigned lanes in the heats for their events.

SUMMARY OF THE INVENTION

One aspect of the invention resides in a method of and product for keeping track of scheduled swim meet events, heats and lanes. Both the method and product require a multiple indicia form be applied to an inside facing surface of a swimming/bathing cap. The multiple indicia form may be imprinted with a conventional dye sublimation heat transfer process.

Preferably, the multiple indicia form has multiple indicia that include, in alignment with each other, the words or abbreviations for "Event", "Heat" and "Lane" repeated some number of times, such as six times. In correspondence with each indicia is spacing, which is located to the side and may include an underline. The spacing needs to be sized to accommodate alphanumeric characters being written in a manner legible for reading back at a later time. The written in alphanumeric characters pertain to the particular event, heat and lane of the swim meet as applicable.

The inventor has found that the mark from a body ink marker is sufficiently water repellent or waterproof to remain intact without erasure when submerged into swimming pool water during a swim meet and to be removable when rubbed or wiped off with aid from a conventional soap or hand sanitizer. The multiple indicia form, if made from the conventional digital dye sublimation heat transfer process, will not come off if rubbed with such conventional soap or hand sanitizer.

The benefit derived from applying the form to the inside facing surface of a swimming/bathing cap as opposed to applying the multiple indicia form to the skin of a swimmer is to avoid an unkempt look that arises from body markings and to avoid potential distraction to fellow competitors that may arise from such body markings. When the multiple indicia form is applied to the inside surface of the swimming/bathing cap, the multiple indicia form is hidden from view as well as the written in alphanumeric characters in the spacing in correspondence with the indicia.

Another aspect resides in commercializing a kit that includes the swimming cap and body ink marker together in a common package or arranged in close proximity to each other at retail that a consumer is encouraged to buy both at the same time, perhaps allowing the consumer choose the color of the body ink marker to be purchased (from a marker dispenser or container) together with the swimming cap. Preferably, the inside facing surface of the swimming cap is imprinted or stamped with the three words "Event", "Heat" and "Lane" or abbreviations of some or all of those three words and to leave space to the right of those words or abbreviations for writing in information with the body marker pertaining to the applicable event, heat and lane. The imprint or stamp may arise from a conventional digital dye sublimation heat transfer process or a conventional ink stamping process. The kit may also include soap or hand sanitizer spray to remove the body marker ink from the spacing in the multiple indicia form to enable reuse to fill in applicable event, heat and lane information at a subsequent swim meet.

The consumer may be encouraged to buy all at the same time, perhaps allowing to consumer to choose the color of the body ink marker to be purchased (from a marker dispenser or container) together with the swimming cap and soap or hand sanitizer. The portion of the inside facing surface of the cap imprinted or stamped with the multiple indicia form and having the written in information in the side spacing constitutes means for identifying a scheduled event, heat and lane of a swimming meet. The portion of the inside surface or the interior facing surface of the cap having the side spacing in correspondence to each of the indicia constitutes means for accommodating writing in of the information in alphanumeric characters in a manner legible for reading back later on.

BRIEF DESCRIPTION OF THE DRAWING

For a better understanding of the present invention, reference is made to the following description and accompanying drawings, while the scope of the invention is set forth in the appended claims

DETAILED DESCRIPTION OF THE INVENTION

Figure 1:
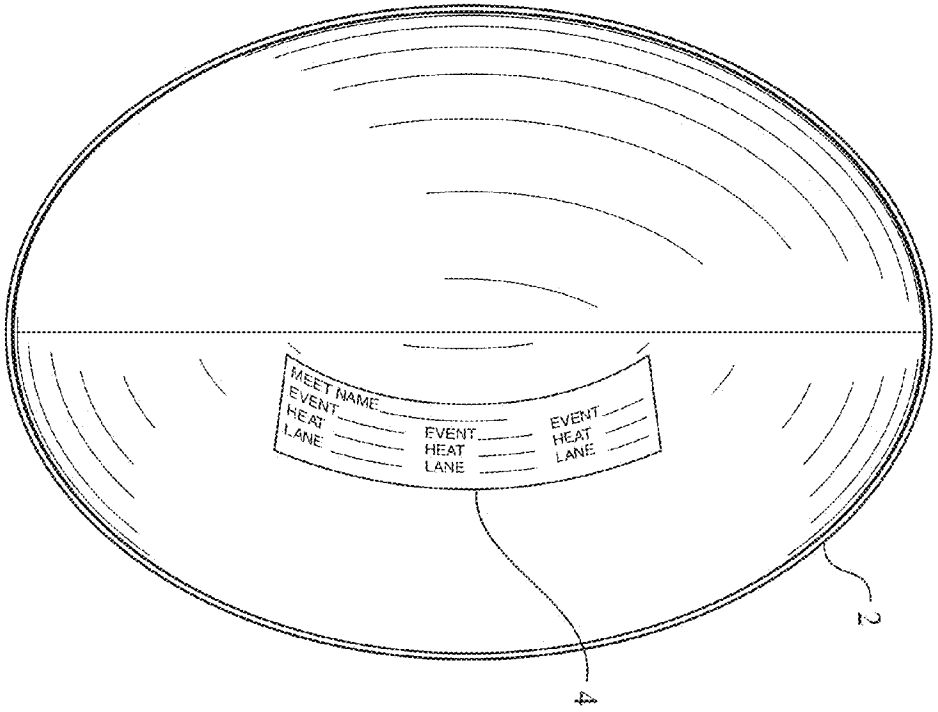
FIG. 1 shows an inside view of a swim meet (competition) swimming cap in accordance with the invention.

Turning to the drawing, FIG. 1 shows the silhouette of a swimming/bathing cap 2 as viewed looking in at the inside facing surface of the swimming/bathing cap. The inside facing surface is worn on the head to face the head of the wearer ad the outside facing surface, which may have a logo imprinted, faces away from the wearer's head when the cap is worn by the wearer. The swimming/bathing cap 2 is made of a material that has elastic properties and selected from the group consisting of silicone, latex and lycra so as to be water repellent or water resistant. The swimming/bathing cap is configured to cover the wearer's head from forehead to behind ears to nape of the neck.

Figure 2:
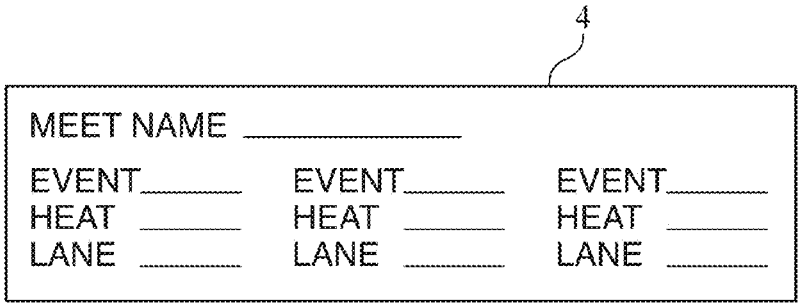
FIG. 2 shows a form in accordance with the invention that may be imprinted on the inside facing surface of the swimming cap of FIG. 1 to identify the swim meet competition and applicable events, heats and lanes of the wearer.
Figure 3:
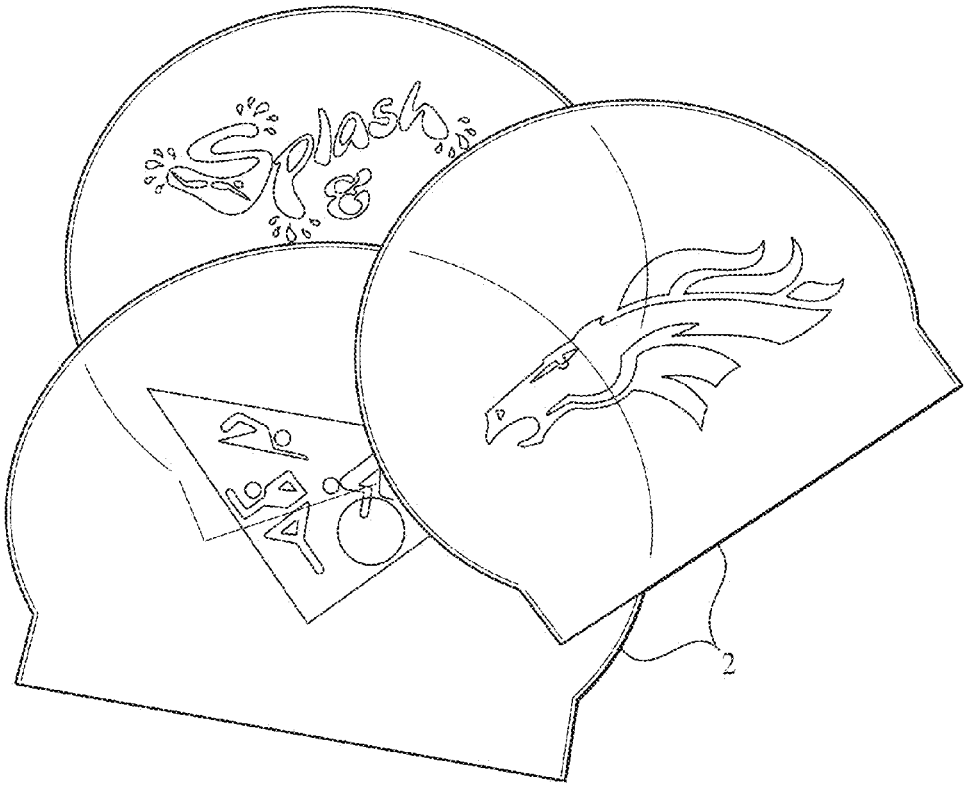
FIG. 3 (PRIOR ART)
FIG. 3 shows conventional swimming caps as commercialized that are imprinted with conventional logos on the outside facing surface of the swimming caps.

FIG. 2 exemplifies a multiple indicia form 4 that is imprinted on the inside facing surface of the swimming/bathing cap. A conventional heat transfer dye sublimation process may be used to do the imprinting. Indeed, the multiple indicia form 4 may be imprinted directly onto the inside facing surface using the same conventional digital printing techniques used to imprint indicia such as logos on the outside surface or exterior face of swimming/bathing caps as in FIG. 3. Such caps are commercialized under the Kiefer brand at www.kiefer.com and owned by Adolph Kiefer and Associates.

There are also body stamp devices available for swim meets that enable the competitor to stamp their skin with the body stamp to leave an inked multiple indicia form on their body. In theory, such a body stamp device could be likewise be used to apply a stamp impression to the inside facing surface of a swimming/bathing cap that is of the multiple indicia form. Unfortunately, such an approach is cumbersome because the body stamp device would need to be made available for each swim meet because the ink from the stamped multiple indicia form would likely rub off with the rubbing off of the body marker ink. The body stamp device would need to be inked, which is potentially messy if handled incorrectly, and there needs to be sufficient ink present or it cannot be applied, which means that surplus ink to refill may need to be carried to the swim meet as well. Further, re-stamping the multiple indicia form for each meet is somewhat time consuming since it would need to be applied to the inside facing surface of the cap dry without folds present in that region of the cap where the stamp is to make contact. However, the main inconvenience is that the original stamped multiple indicia form would need to be removed in its entirety or parts of it will remain when the re-applied stamping takes place, which look like smudges or blotches adjacent to the newly applied ink from the re-stamping.

Figure 4:
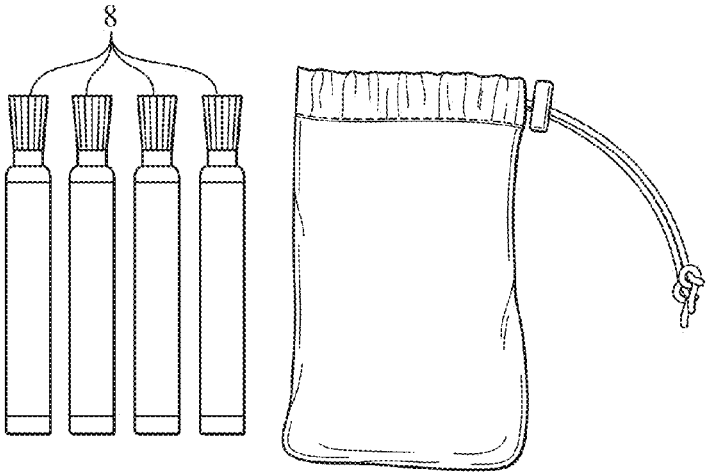
FIG. 4 (PRIOR ART)
FIG. 4 shows conventional body ink markers with bag.

FIG. 4 shows conventional ink body markers 8 and a bag for holding them as commercialized by Take Your Mark Sports, LLC. The body markers 8 preferably have ink resistant to erasure from water submersion and may be waterproof.

Figure 5:
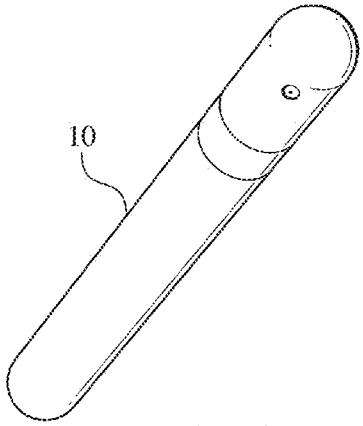
FIG. 5 (PRIOR ART)
FIG. 5 shows an isometric view of a convention hand sanitizer spray.

FIG. 5 shows a conventional hand sanitizer spray 10 such as that commercialized under the tradename NATURAL TRENDS at www.naturaltrends.com/Sani-Pen2SprayHome.htm. The ink from the body marker should be removable by applying soap or the hand sanitizer to the ink in the spacing on the inside of the cap after washing and rubbing or wiping it off with a paper towel.

The common packaging may be of a plastic material. The sealing of the packaging may be effected in any conventional manner, such as by thermal welding, sonic welding, and press-to-seal strips that are reclosable such as Ziploc or with snaps or a zipper.

Figure 6:
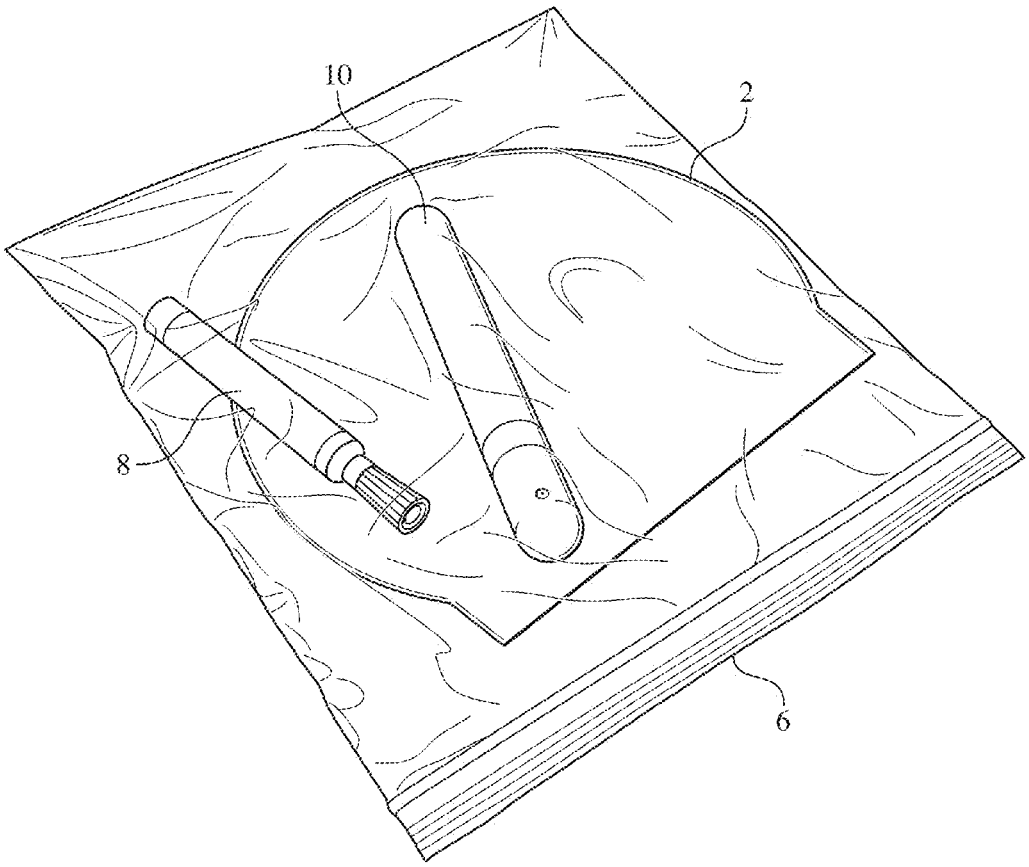
FIG. 6 shows a swim meet competition kit in accordance with the invention.

FIG. 6 shows a merchandize display in close proximity to swimming competition items, i.e., the swimming/bathing cap imprinted on its inside face with sets of indicia (meet, event, heat, lane), ink body markers and removers of the marks left by the ink body markers (e.g., a hand sanitizer spray).

Figure 7:
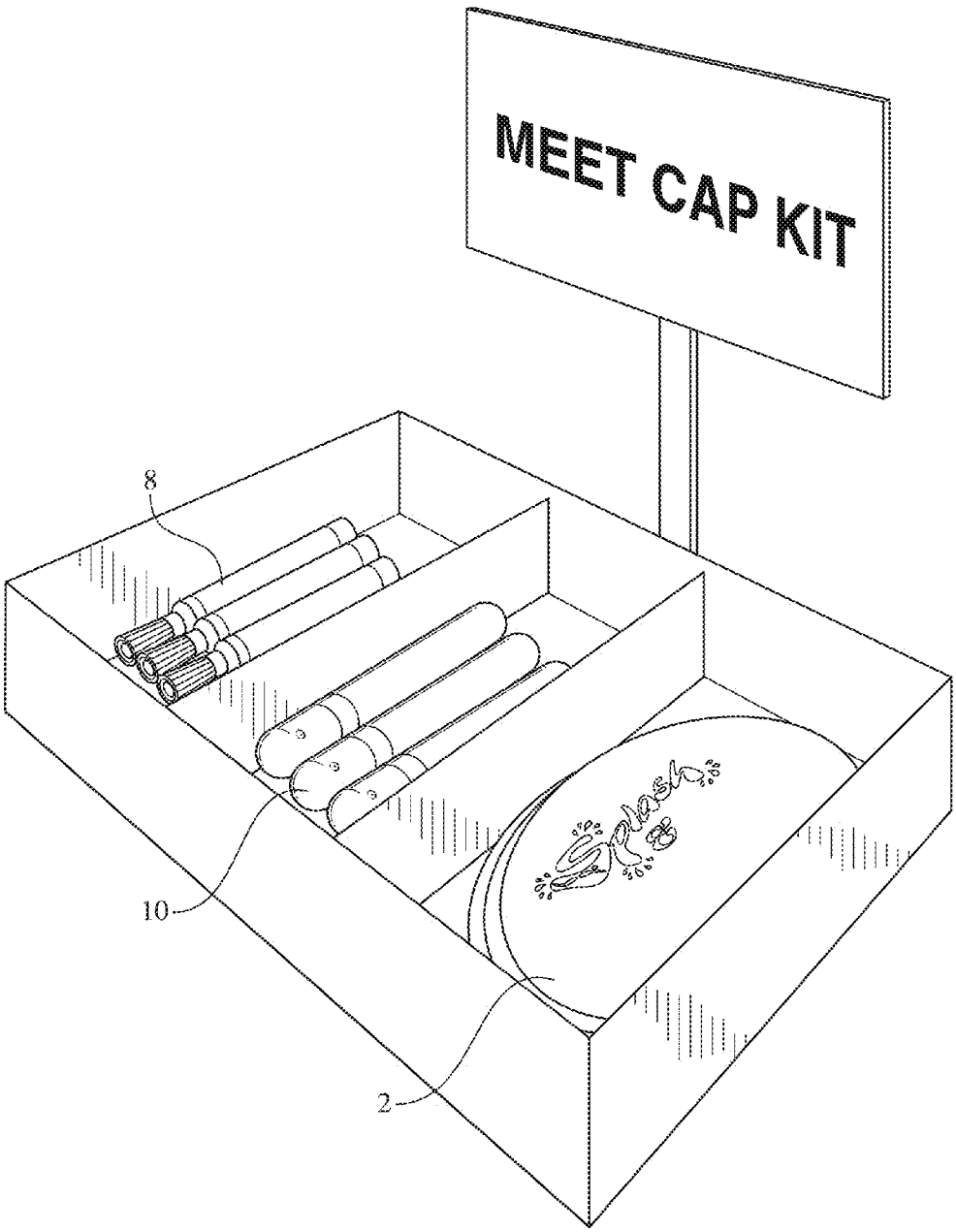
FIG. 7 shows a merchandize display that promotes competition swim meet caps of FIG. 1, body ink markers of FIG. 4 and hand sanitizer sprays of FIG. 5 within separate compartments in the display in accordance with the invention.

FIG. 7 exemplifies either a physical layout in a retail store to the items in relative close proximity to the promotional display so that would be purchasers can see them all. The promotional display may be made of cardboard, plastic, wood or metal.

Figure 8:
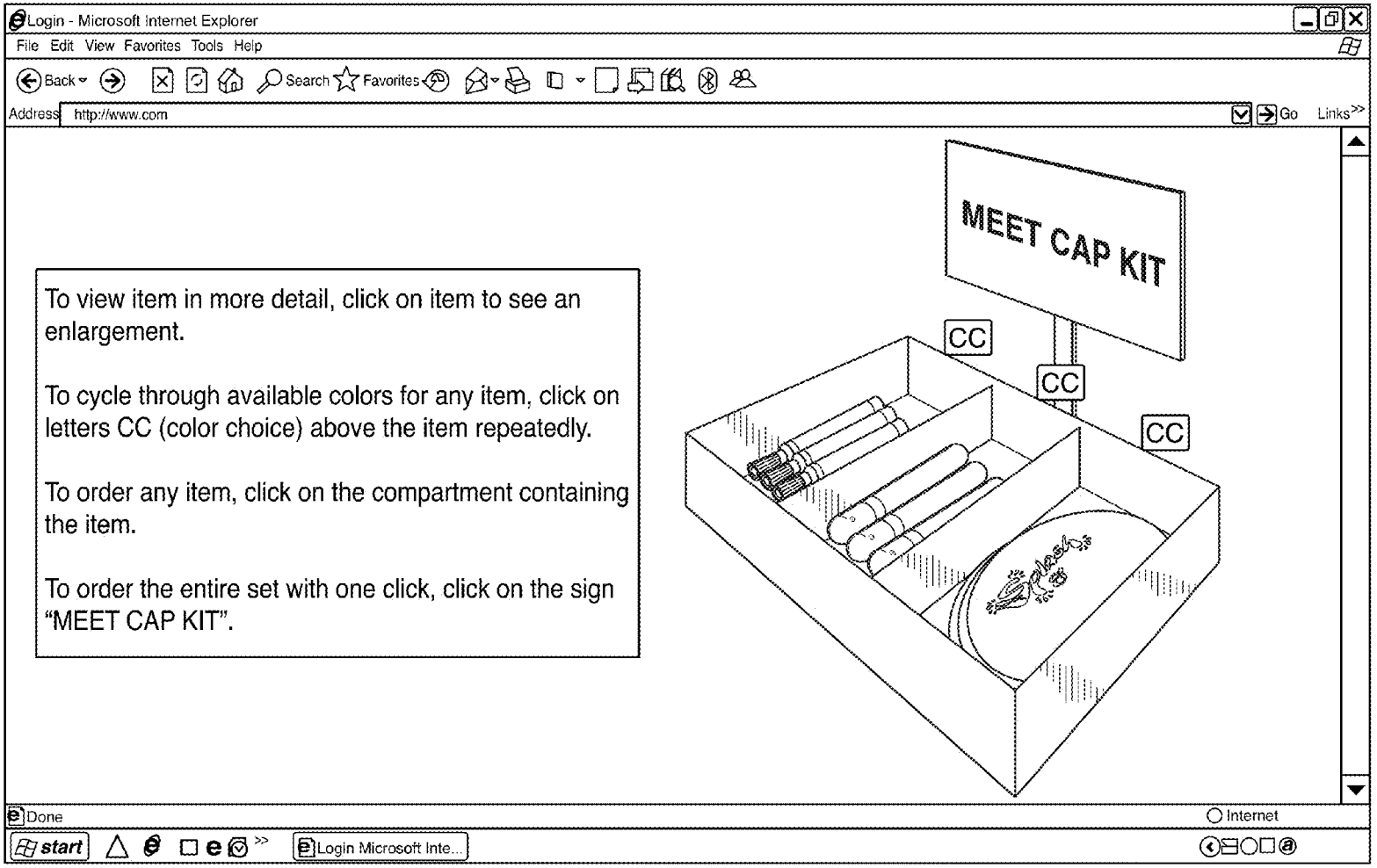
FIG. 8 shows a virtual image of the merchandize display of FIG. 7 on a web page.

FIG. 8 exemplifies a web page with a virtual image of the display of FIG. 7, but offers the user the ability to click on appropriate portions of the virtual image to order individual items or the entire set or to cycle through color choices for each of the items or see enlargements for each of the items. An enlargement for the cap may reveal a view externally (see FIG. 3) and internally (see FIG. 1).

Figure 9:
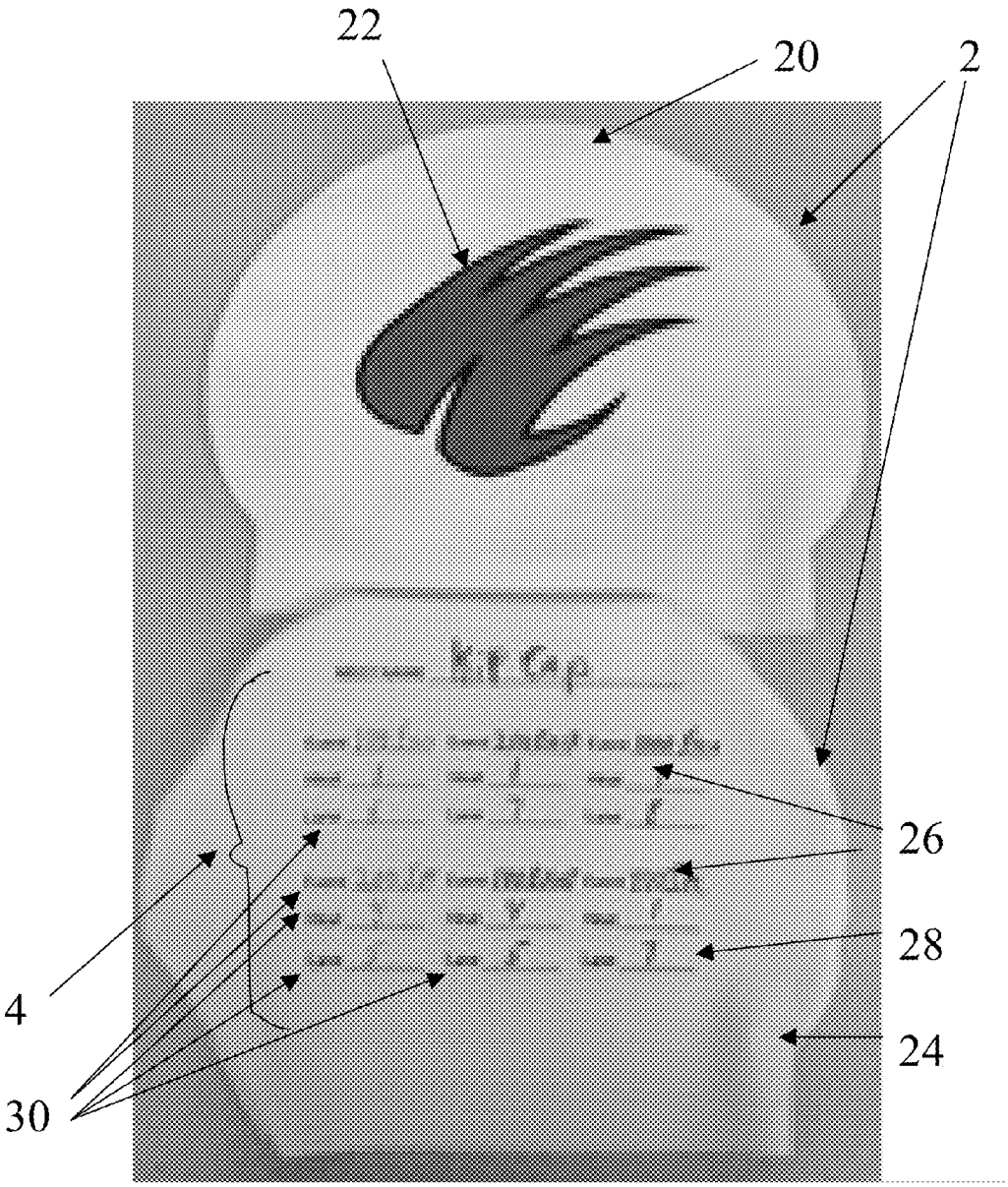
FIG. 9 shows two caps in accordance with the invention with one cap having an outside facing surface exposed and the other having an inside facing surface exposed. The top of the latter cap is shown placed atop the bottom of the former cap.

FIG. 9 shows two swimming/bathing caps 2*a*, 2*b* of the present invention with one of the caps 2*a* exposing an outside facing surface 20 with a logo 22 imprinted on the outside facing surface 20 and the other of the caps 2*b* exposing an inside facing surface 24 with a stamped imprint on the inside facing surface 24 that has the multiple indicia 30. In addition, body marker ink 26 is applied to form legible alphanumeric characters in the spacing 28 associated in correspondence with each of the multiple indicia 30 of the multiple indicia form 4 on the inside facing surface 24 to signify the swim meet, event, heat and lane information by forming alphanumeric characters that pertain to the scheduled events, heats and lanes of the swim meet.

There are advantages in accordance with the present invention for keeping child competitors informed as to the event, heat and lane assigned to them to compete in a swimming competition over the current practice of writing such information with an ink body marker on the hands or arms of the child competitor.

First, the child competitor is not charged with devising a format to record the event/heat/lane information on their bodies that they will need to interpret later. Instead, a format in the multiple indicia form 4 of a fill in chart is imprinted or stamped on the inside facing surface of their swimming/bathing cap that is readily filled out either by the child, parent or swimming coach in advance.

Second, the swimming coach may not need to even refer to the posted swimming heat data schedule if the information is clearly filled in on the chart imprinted in the swimming/bathing cap. This contrasts with the case when the information is written on the child's body since the swimming coach may not readily know the format the child used to write the information on their bodies to properly interpret what was written and thus would consult with the posted swimming heat data schedule (or one they might have been given by the meet officials).

Third, there may be situations in which there is no adjustment made in the scheduling of swimming events/heats/lanes for no-shows. Thus, the scheduled assignments for event/heat/lanes can be given out in advance and the information filled out in the chart imprinted on the swimming/bathing cap by the parents (or swimming coaches) so that the child need not be responsible to write anything about the event/heat/lane information, which makes the children better prepared for their races, less confused as to their event/heat/lane assignments throughout the meet and thus more relaxed (less stressed) since the information about their event/heat/lane assignments is readily available in their swimming/bathing caps.

The present invention also is concerned with a promotional display at retail and/or on the world wide web. Up to now, no one has come up with an approach that makes it possible for swimming competitors to become cognizant of their event/heat/lane assignments other than from writing pertinent information on their bodies, referring to a posted swimming heat data schedule, or conferring with a swimming coach at the meet. Such an approach brings together at one location or in one kit all the items necessary to fulfill such an approach. That is, the items of an ink body marker, a mark remover (soap or hand sanitizer) and swimming/bathing cap imprinted on its inside with a chart/form to fill in information pertaining to the assigned event/heat/lanes at a swimming meet for the wearer of the swimming/bathing cap. FIGS. 5 and 6 show the kit containing the items and a layout for a merchandize display, whether the display be a physical display at a retail store with all the items arranged in close proximity to each other or all in a commonly packaged kit or depicted in a webpage for ordering.

While the foregoing description and drawings represent the preferred embodiments of the present invention, it will be understood that various modifications may be made without departing from the scope of the present invention.

What is claimed is:

1. A method of keeping track of scheduled events, heats and lanes of a swim meet, comprising the steps of:

accessing an inside facing surface of the swimming/bathing cap that has a region upon which a multiple indicia form is imprinted, the swimming/bathing cap being made of a synthetic material selected from the group consisting of silicone, latex, lycra and any combination thereof, the multiple indicia form having multiple indicia arranged in alignment with each other, the region having associated spacing arranged in correspondence with the multiple indicia, the multiple indicia being designations for scheduled events, heats and lanes of a swim meet; and forming alphanumeric characters with ink in a legible manner within the spacing that pertain to the scheduled events, heats and lanes of the swim meet, the imprinted multiple indicia form being more surface removal resistant than is the ink, the ink resisting erasure from submersion in water so that the alphanumeric characters remain legible after the submersion in water; and concealing the multiple indicia form and the formed alphanumeric characters in a manner hidden from view by wearing the swimming/bathing cap so that the inside facing surface faces a head of the wearer.

2. The method of claim 1, further comprising:

keeping track of the scheduled events, heats and lanes of the swim meet by removing the swimming/bathing cap from being worn to expose the inside facing surface of the swimming/bathing cap to reveal the imprinted multiple indicia form and the alphanumeric characters that remain legible within the spacing.

3. The method of claim 1, wherein the concealing includes the wearing of the swimming/bathing cap on a wearer's head in a manner that covers the wearer's head from the forehead to behind the ears to the nape of the neck so as to have the inside facing surface facing the wearer's head when worn on the wearer's head and an outside facing surface facing away from the wearer's head when worn on the wearer's head, the outside facing surface having an imprinted logo.

4. The method of claim 1, further comprising:

removing the swimming/bathing cap from being worn;

removing the legible alphanumeric characters by applying a hand sanitizer fluid or soap to the ink within the associated spacing; and then washing or wiping away the ink from the associated spacing, the multiple indicia form remaining despite the applying of the hand sanitizer fluid or soap to the ink and the washing or wiping away of the ink.

5. The method of claim 1, further comprising;

opening a package containing both the swimming/bathing cap and a marker, the marker having the ink resistant to erasure from submersion in water, the step of forming the alphanumeric characters with the ink being effected with the marker.

6. The method of claim 5, wherein the package also contains a sprayer containing a hand sanitizer fluid suited to spray the sanitizer fluid onto the ink in the spacing to remove the ink from the spacing when washed or wiped away.

7. The method of claim 1, wherein the imprinting includes carrying out a heat transfer dye sublimation process to imprint the multiple indicia form into the region.

8. A product to keep track of scheduled events, heats and lanes of a swim meet in a manner that is hidden from view as a swimming/bathing cap is worn, comprising:

a swimming/bathing cap of a synthetic material selected from the group consisting of silicone, latex and lycra and any combination thereof;

a multiple indicia form imprinted onto a region of an inside facing surface of a swimming/bathing cap, the multiple indicia form having multiple indicia arranged in alignment with each other, the region having associated spacing arranged in correspondence with the multiple indicia, the multiple indicia being designations for scheduled events, heats and lanes of a swim meet; and alphanumeric characters formed with ink in a legible manner within the spacing that pertain to the scheduled events, heats and lanes of the swim meet, the imprinted multiple indicia form being more surface removal resistant than is the ink, the ink resisting erasure from submersion in water so that the alphanumeric characters remain legible after the submersion in water, wherein the multiple indicia form and the formed alphanumeric characters are concealed in a manner hidden from view as the swimming/bathing cap is worn with the inside facing surface of the swimming/bathing cap facing a head of the wearer.

9. The product of claim 8, further comprising:

opening a package containing both the swimming/bathing cap and a marker, the marker having the ink resistant to erasure from the submersion in water.

10. The product of claim 9, wherein the package also contains a sprayer containing a hand sanitizer fluid suited to spray the sanitizer fluid onto the ink in the spacing to remove the ink from the spacing when washed or wiped away.

* * * * *